United States Patent [19]

Ishikawa et al.

[11] Patent Number: 4,733,208

[45] Date of Patent: Mar. 22, 1988

[54] DIELECTRIC FILTER HAVING IMPEDANCE CHANGING MEANS COUPLING ADJACENT RESONATORS

[75] Inventors: Youhei Ishikawa; Kikuo Tsunoda; Toshiro Hiratsuka, all of Nagaokakyo, Japan

[73] Assignee: Murata Manufacturing Co., Ltd., Japan

[21] Appl. No.: 766,263

[22] Filed: Aug. 16, 1985

[30] Foreign Application Priority Data

Aug. 21, 1984 [JP] Japan ..... 59-173586

[51] Int. Cl.[4] ..... H01P 1/205

[52] U.S. Cl. ..... 333/202; 333/206

[58] Field of Search ..... 333/202, 219, 235, 222–226, 333/206, 204

[56] References Cited

U.S. PATENT DOCUMENTS

| | | | |
|---|---|---|---|
| 4,386,328 | 5/1983 | Masuda et al. | 333/202 |
| 4,431,977 | 2/1984 | Sokola et al. | 333/222 X |
| 4,506,241 | 3/1985 | Makimoto et al. | 333/219 X |
| 4,546,333 | 10/1985 | Fukasawa et al. | 333/202 |

*Primary Examiner*—Eugene R. LaRoche
*Assistant Examiner*—Benny Lee
*Attorney, Agent, or Firm*—Ostrolenk, Faber, Gerb & Soffen

[57] ABSTRACT

A dielectric filter comprises a cubic dielectric block in which a plurality of holes arranged in the longitudinal direction are formed vertically therethrough. On outer surfaces of the dielectric block, an outer conductor is formed except on the upper surface. On inner surfaces of a plurality of the holes, inner conductors constituting resonance elements in cooperation with the outer conductor are formed. Grooves are formed in the dielectric block between the adjacent resonance elements. Thereby, impedance of a part of a lengthwise direction of at least one of the adjacent resonance elements differs from that of the other part, at least in one of the even and odd modes. In order to have different impedances, notches may be formed on the dielectric block between the adjacent inner conductors or large and small diameter portions may be formed in the holes or further the two methods may be combined.

10 Claims, 24 Drawing Figures

DIELECTRIC FILTER HAVING IMPEDANCE CHANGING MEANS COUPLING ADJACENT RESONATORS

BACKGROUND OF THE INVENTION

1. Field of the Invention

The present invention relates to a dielectric filter. More specifically, the present invention relates to an integral type dielectric filter, in which a plurality of resonance elements are formed within a dielectric block.

2. Description of the Prior Art

A conventional dielectric filter of this type is disclosed, for example, in the International Publication No. WO 83/0285 published internationally on Aug. 18, 1983. In the dielectric filter, each resonance element R may be coupled by the gap capacity C formed by the electrodes on the open end side of each resonance element R as shown in an equivalent circuit diagram of FIG. 1.

In the prior art cited, the dielectric block can be easily produced, since holes or slits for coupling each resonance element are not needed to be formed in the dielectric block. However, in the prior art, it is necessary to form electrodes on the open end surface for forming the gap capacity to couple each resonance element. In order to form the electrodes on the open end surface, additional processings such as etching or patterning different from the forming process of an outer conductor or inner conductors are required, thus resulting in complicated processings.

SUMMARY OF THE INVENTION

It is, therefore, a principal object of the present invention to provide a dielectric filter which can be produced easier by utilizing a coupling principle which differs from the prior art.

In brief, the present invention is a dielectric filter, wherein an impedance of a part of the lengthwise direction of at least one of adjacent resonance elements formed inside a dielectric block is made to differ from the impedance of another part at least in one of the even and odd modes.

In that case, the impedance in the even and odd modes of the adjacent two resonance elements differs from each other, resonance frequencies in the even and odd modes of both resonance elements differ respectively, thus satisfying the coupling condition. Thereby, the adjacent resonance elements are coupled mutually and constituted as the dielectric filter.

According to the present invention, since electrodes for the gap capacity are not necessary to be formed, the production process may be simplified as compared with the cited prior art. More specifically, in the present invention, since the electrodes are not required on the open end surface and, for example, the outer surfaces of the dielectric block are just needed to be plated throughly and the plated portion on the open end surface is to be removed thereafter, the elaborate patterning as the prior art is not necessary, thus the process can be simplified.

In the preferred embodiment of the present invention, a groove is formed on the open end surface side or the opposite end side of the dielectric block between the adjacent resonance elements, namely the inner conductors. The electrostatic capacity values formed by the inner and outer conductors differ between the grooved and non-grooved portions in the lengthwise direction of the dielectric block, namely, the resonance elements, thus the coupling condition is satisifed as the impedance in the odd modes differ in the two portions.

In another preferred embodiment of the present invention, a notch is formed in a lengthwise direction from the side of the dielectric block between the adjacent resonance elements, namely, the inner conductors. The impedance in the both of the even and odd modes differ between the notched and non-notched portions as the foregoing, thus satisfying the coupling condition.

In a further preferred embodiment of the present invention, at least one of the inner conductors constituting the adjacent resonance elements includes a large diameter portion and a small diameter portion formed at the different positions in the lengthwise direction. The impedance in both the even and odd modes differ between the large and small diameter portions, when impedance ratios of the even and odd modes differ from each other, thus the coupling condition is satisfied.

These and other objects, features, aspects and advantages of the present invention will become more apparent from the following detailed description of the embodiment of the present invention when taken in conjunction with accompanying drawings.

PRINCIPLE OF THE INVENTION

As previously described, in the prior art cited, in order to satisfy the coupling condition ($\omega_{even} \neq \omega_{odd}$: where, $\omega_{even}$ is a resonance frequency in the even mode and $\omega_{odd}$ is that in the odd mode), a gap capacity was formed by the electrode formed on the open end surface.

On the other hand, in the present invention, the coupling condition ($\omega_{even} \neq \omega_{odd}$) is satisifed and the adjacent resonance elements are coupled by dffering or discontinuing the impedance of a part in a lengthwise direction of a resonance element from that of the other part in the even or odd modes.

In the following, the principle of coupling in accordance with the present invention will be described by introducing formulas.

Figure 1:
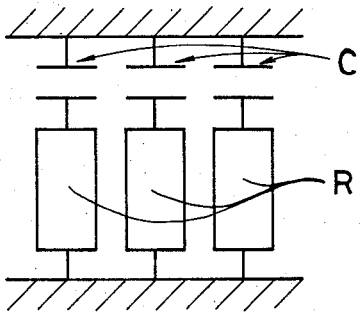
FIG. 1 PRIOR ART
FIG. 1 is an equivalent circuit diagram for explaining the prior art.
Figure 2:
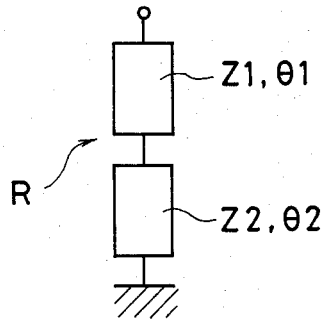
FIG. 2 is an equivalent circuit diagram for explaining the principle of the present invention.

FIG. 2 is an equivalent circuit diagram for explaining the principle in accordance with the present invention. In the example, a resonance element R includes two portions divided in the lengthwise direction, wherein the impedance and an electrical angle of one portion are denoted respectively as Z1 and $\theta 1$ and those of the other portion as Z2 and $\theta 2$ respectively. In this case, the total impedance of the resonance elements R may be formulated in the following Formula (1), $$Z = jZ1 \frac{Z1\tan\theta 1 + Z2\tan\theta 2}{Z1 - Z2\tan\theta 1\tan\theta 2} \quad (1)$$

Here the resonance condition is that the impedance Z becomes infinite. Accordingly, choosing $\theta$ as the denominator of Formula (1), the resonance condition can be expressed by the following Formula (2), $$Z1 - Z2 \tan\theta 1 \tan\theta 2 = 0 \quad (2)$$

Then, denoting respective impedance Z1 and Z2 in the even mode as $Z1_{even}$ and $Z2_{even}$, and modifying Formula (2), Formula (3) can be obtained as the resonance condition in the even mode.

$$Z1_{even} = Z2_{even} \tan\theta 1 \tan\theta 2 \quad (3)$$

Here, choosing $Z1_{odd}$ and $Z2_{odd}$ as respective impedance Z1 and Z2 in the odd mode, and modifying Formula (2), Formula (4) may be obtained as the resonance condition in the odd mode.

$$Z1_{odd} = Z2_{odd} \tan\theta 1 \tan\theta 2 \quad (4)$$

Now, for the purpose of simplicity, assuming the respective electrical angles $\theta 1$ and $\theta 2$ as the similar electrical angle $\theta 0$ ($\theta 1 = \theta 2 = \theta 0$), and modifying thereof, Formulaes (3) and (4) change to Formulas (5) and (6).

$$\tan^2\theta 0 = Z1_{even}/Z2_{even} \quad (5)$$

$$\tan^2\theta 0 = Z1_{odd}/Z2_{odd} \quad (6)$$

Meanwhile, the condition shown in following Formula (7) is given so that at least one of the impedance Z1 and Z2 is differed at least in one of the even and odd modes.

$$\frac{Z1_{even}}{Z2_{even}} \neq \frac{Z1_{odd}}{Z2_{odd}} \quad (7)$$

While, the electrical signal $\theta$ can be formulated generally by Formula (8), when a dielectric constant of medium is $\epsilon$ and a physical length related to the impedance is l.

$$\theta = \sqrt{\epsilon l \omega}/\text{light speed} \quad (8)$$

In order to satisfy the previous Formula (7), the electrical signals $\theta 1$ and $\theta 2$ must be differed at least in one of the even and odd modes. For this purpose, eventually, condition of the following Formula (9) must be satisfied, since the constant ($\epsilon$, l and light velocity) in Formula (8) is constant irrespective of the even or odd modes.

$$\omega_{even} \neq \omega_{odd} \quad (9)$$

The Formula (9) is nothing but the coupling condition previously described, so that for enabling the adjacent resonance elements to couple to each other, it will be understood that the impedance of a part in the lengthwise direction of at least one of the adjacent resonance elements, may be made to differ from that of the other parts, at least in one of the even and odd modes, and thus, Formula (7) may be satisified.

In the present invention, the dielectric filter is constituted by structurally realizing the condition of Formula (7).

DESCRIPTION OF THE PREFERRED EMBODIMENTS

Figure 3:
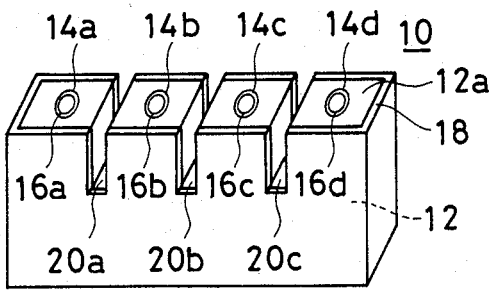
FIG. 3 is a perspective view showing one embodiment in accordance with the present invention.

FIG. 3 is a perspective view showing one embodiment in accordance with the present invention. A dielectric filter 10 comprises a cubic dielectric block 12. Holes 14a, 14b, 14c and 14d extending from one surface, that is, an open end surface 12a to an opposite end surface, are arranged in line in parallel with each other. Then, on inner surfaces of the holes 14a, 14b, 14c and 14d, inner conductors 16a, 16b, 16c and 16d are respectively formed and an outer conductor 18 is formed on the periphery of the dielectric block 12. The end surface opposite the open end surface 12a of the dielectric block 12 is covered by the outer conductor 18, thus in the embodiment, a plurality of TEM dielectric coaxial resonance elements of $\lambda/4$ are formed.

Now, in the embodiment, characteristically, grooves 20a, 20b and 20c extending from one surface to the other surface of the dielectric block 12 are formed respectively on upper portions in the lengthwise direction of the resonance elements between each resonance element, that is, between the inner conductors 16a–16d. That is, in the embodiment, previous Formula (7) is realized by the grooves 20a–20c.

Figure 4:
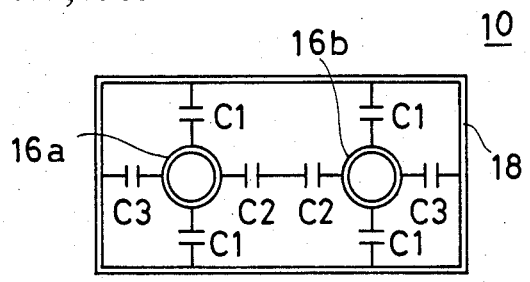
FIG. 4 is an illustrative view showing an electrostatic capacity formed between inner conductors and an outer conductor for explaining the embodiment of FIG. 3.

FIG. 4 is an illustrative view showing an electrostatic capacity formed between the inner and outer conductors for explaining the embodiment of FIG. 3. Here, referring to FIG. 4, how the Formula (7) in the embodiment of FIG. 3 is realized, will be described.

For example, impedance Z of the resonance element formed by the inner conductor 16a and outer conductor 18 is proportional to the sum of each electrostatic capacity as formulated in the following Formula (10), $$Z \propto 1/\Sigma C \tag{10}$$

Now, choosing $Z_{odd}$ as the impedance in the odd mode and considering respective electrostatic capacities C1, C2 and C3, then $$Z_{odd} \propto \frac{1}{(2C1 + C2 + C3)} \tag{11}$$

Meanwhile, the impedance $Z_{even}$ in the even mode may be formulated by Formula (12), since the inner conductors 16a and 16b become equipotential in the even mode and the electrostatic capacity C2 to be formed therebetween is not formed.

$$Z_{even} \propto \frac{1}{(2C1 + C3)} \tag{12}$$

However, when viewing the odd mode, the electrostatic capacity C2 in Formula (11) becomes smaller in the upper portion, which has the groove, since depending on the presence of groove 20 (FIG. 3), the dielectric constant of medium acting thereupon changes. Accordingly, when choosing $Z1_{odd}$ as the impedance of upper portion of the resonance element with the groove 20a (FIG. 3) and $Z2_{odd}$ as that of the lower portion without the groove, the former is larger than the latter. That is, the impedance Z1 and Z2 differs from each other in the odd mode. Whereas, in the even mode, the impedance Z1 and Z2 are equal irrespective of the presence of grooves. Thus, in the embodiment of FIG. 3, Z1 differs from Z2 ($Z1 \neq Z2$) inthe odd mode and the coupling condition in Formula (9) is realized, since the impedance condition of Formula (7) is satisified.

Figure 5:
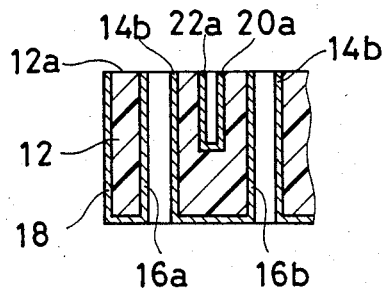
FIG. 5 is a cross-sectional view of a major portion showing a modified example of the embodiment of FIG. 3.

FIG. 5 is a cross-sectional view of a major portion showing a modified example of the embodiment of FIG. 3. The embodiment differs from that of FIG. 3 in the point that, electrodes 22a connected electrically to the outer conductor 18 have been formed on the aforementioned groove surfaces. Meanwhile, in FIG. 5, although only the electrode 22a formed on the surface of the groove 20a is shown, the electrodes are similarly formed also in the groove 20b and 20c (FIG. 3).

In the embodiment, if there is scarcely any gap in the groove 20a, the even mode impedance $Z1_{even}$ of the impedance Z1 of the upper part becomes equal to the odd mode impedance $Z1_{odd}$. However, in fact, since the groove gap is not zero, the even mode impedance $Z1_{even}$ becomes smaller than the odd mode impedance $Z1_{odd}$. On the other hand, when viewing the impedance Z2 of the lower part, the odd mode impedance $Z2_{odd}$ differs from the even mode impedance $Z2_{even}$ as same as the embodiment of FIG. 3. Accordingly, in the embodiment of FIG. 5, Z1 is not equal to Z2 ($Z1 \neq Z2$) in both the even and odd modes, thus the condition of the Formula (7) is satisfied and the coupling is effectuated.

Figure 6:
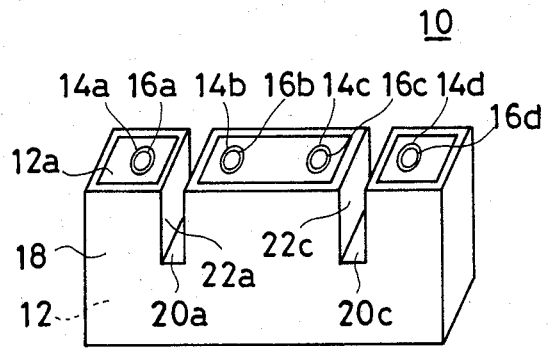
FIG. 6 is a perspective view showing a modified example of the embodiment of FIG. 5.

FIG. 6 is a perspective view showing a modified example of the embodiment of FIG. 5. The example differs from the embodiment of FIG. 5 in the point that, only grooves 20a and 20c and corresponding electrodes 22a and 22c are present, there being no groove 20b formed between the adjacent resonance elements in the center. In this embodiment, between all of the resonance elements formed by the inner conductors 16a–16d, the condition expressed by the previous Formula (7) is satisfied, whereby the coupling is effectuated. Thus, grooves are not necessary to be formed between all adjacent resonance elements as shown in the embodiment of FIG. 6.

Figure 7:
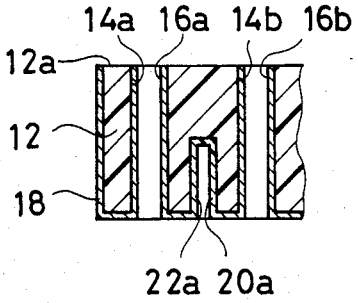
FIG. 7 is a cross-sectional view of a major portion showing a modified example of the embodiment of FIG. 5.

FIG. 7 is a cross-sectional view showing a major portion of a modified example of the embodiment of FIG. 5. In the embodiment, the groove 20a and corresponding electrode 22a are formed on the end surface opposite the open end surface 12a of the dielectric block 12, namely, on the short circuit end surface side. Although only the groove 20a is shown also in FIG. 7, other grooves are also formed similarly on the lower part of the dielectric block 12. In the embodiment, the impedance Z1 and Z2 of the upper and lower parts of each resonance element differs from each other ($Z1 \neq Z2$) in both the even and odd modes, thus the condition of the Formula (7) is satisfied and the coupling is effectuated.

Figure 8:
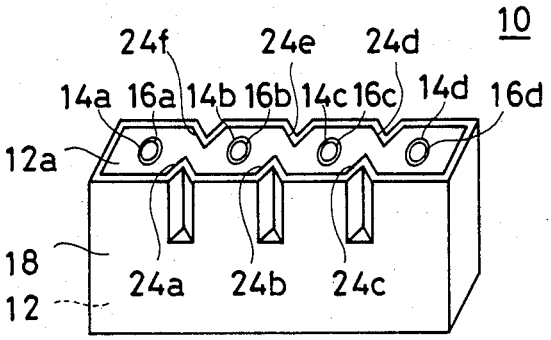
FIG. 8 is a perspective view showing another embodiment in accordance with the present invention.

FIG. 8 is a perspective view showing another embodiment in accordance with the present invention. In the embodiment, notches 24a, 24b, 24c, 24d, 24e and 24f are formed on the upper parts in the vertical direction of the resonance elements between the respective inner conductors 16a, 16b, 16c and 16d on both sides of the dielectric block 12 for coupling each resonance element. Surfaces of the notches 24a–24f are covered by the outer conductor 18. With such notches 24a–24f, the coupling condition of Formula (7) may be realized as to be described below.

Figure 9:
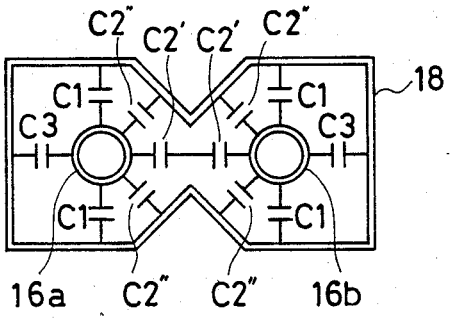
FIG. 9 is an illustrative view showing an electrostatic capacity formed between inner conductors and an outer conductor for explaining the embodiment of FIG. 8.

FIG. 9 is an illustrative view showing an electrostatic capacity formed between the inner and outer conductors for explaining the embodiment of FIG. 8.

For example, impedance Z of the resonance element constituted by the inner conductor 16a and outer conductors 18, is proportional to the sum of each electrostatic capacity as the previous Formula (10), and the impedance $Z_{odd}$ in the odd mode can be formulated by the following Formula (13) when the respective electrostatic capacities C1, C2 (FIG. 4), C2', C2'' and C3 are taken into consideration.

$$Z_{odd} \propto \frac{1}{(2C1 + 2C2'' + C3 + C2')} = \frac{1}{(2C1 + 2C2 + C3)} \tag{13}$$

Furthermore, the even mode impedance $Z_{even}$ can be expressed by the following Formula (14), since the inner conductors 16a and 16b become equipotential and the electrostatic capacity C2 to be formed therebetween is not formed.

$$Z_{even} \propto \frac{1}{(2C1 + 2C2'' + C3)} \tag{14}$$

The electrostatic capacity 2C2'' in Formula (14) is smaller as compared with the original electrostatic capacity C2, since it is a residue of capacity C2 which has been dispersed and the part thereof being incorporated into the capacity C1.

However, when viewing the odd mode, the electrostatic capacity C2 in Formula (13) becomes smaller in the upper part with the notch, since depending on the presence of notch, the effective dielectric constant of medium acting thereupon changes. Accordingly, when choosing $Z1_{odd}$ as the impedance of the upper part of the resonance element with the notch 24a (FIG. 8) and $Z2_{odd}$ as that of the lower part without the notch, the former is larger than the latter. That is, the impedance Z1 and Z2 differs from each other ($Z1 \neq Z2$) in the odd mode. In the even mode, the impedance Z1 and Z2 differ from each other by means of the presence of notch. Thus, in the embodiment of FIG. 8, Z1 differs from Z2 ($Z1 \neq Z2$) in both of the odd and even modes and the Formula (7) is satisfied, whereby the coupling is effectuated.

Figure 10:
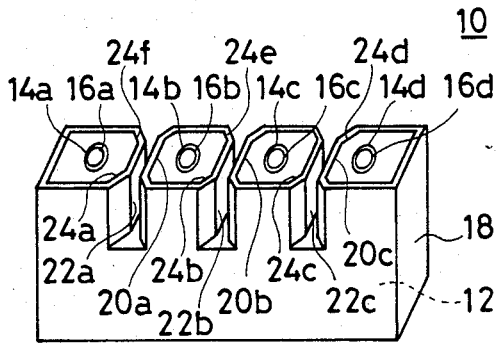
FIG. 10 is a perspective view showing a further modified example of the embodiment of FIG. 5.

FIG. 10 is a perspective view showing a modified example of the embodiment of FIG. 5. The embodiment differs from that of FIG. 5 in the point that, notches 24a–24f are formed on the dielectric block 12. The notches 24a–24f are formed on the upper part in the vertical direction of the dielectric block 12. In the embodiment, the coupling between each resonance element are effectuated by the grooves 20a–20c corresponding electrodes 22a–22c also being provided, and the characteristic impedance of each resonant element can be adjust by the notches 24a–24f.

Figure 11:
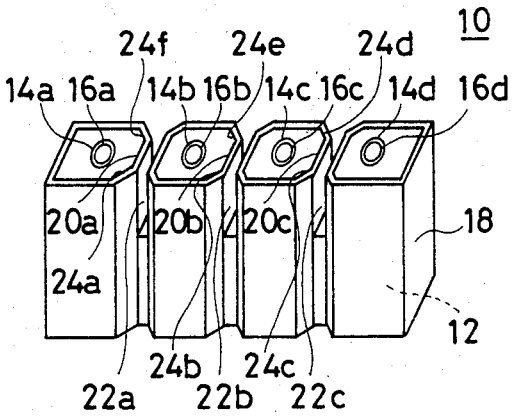
FIG. 11 is a perspective view showing a modified example of the embodiment of FIG. 10.

FIG. 11 is a perspective view showing a modified example of the embodiment of FIG. 10. The embodiment differs from that of FIG. 10 in the point that, the notches 24a–24f for adjusting the characteristic impedance of the resonance element have been formed entirely in the vertical direction of the dielectric block 12 from the open end surface 12a to the opposite end surface thereof.

Figure 12:
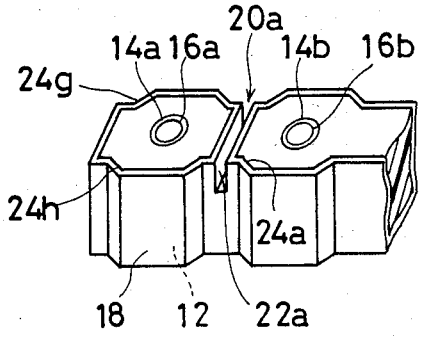
FIG. 12 is a perspective view of a major portion showing a modified example of the embodiment of FIG. 11.

FIG. 12 is a perspective view of a major portion showing a modified example of the embodiment of FIG. 11. In the embodiment, notches 24g and 24h are formed also on both ends of the disposed direction of the resonance elements of the dielectric block 12 entirely in the vertical direction.

Figure 13:
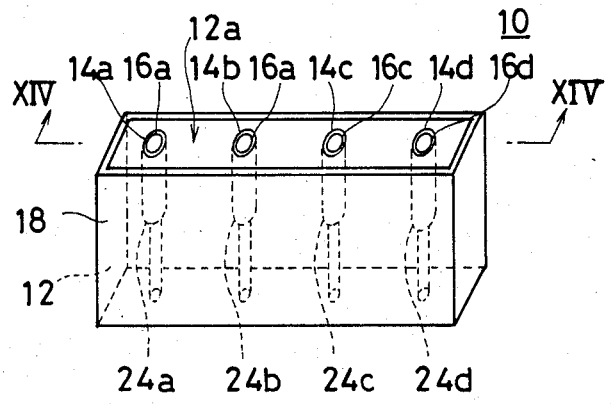
FIG. 13 is a perspective view showing a further embodiment in accordance with the present invention.
Figure 14:
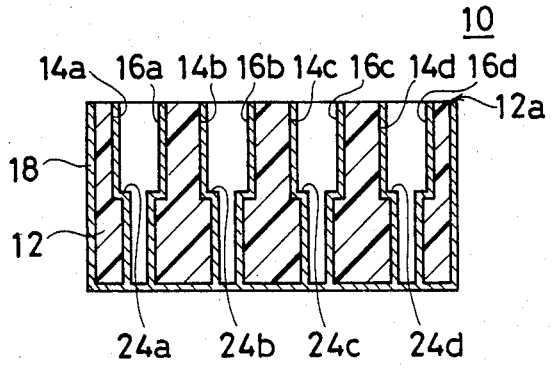
FIG. 14 is a cross-sectional view taken on line XIV—XIV of FIG. 13.

FIG. 13 is a perspective view showing a further embodiment in accordance with the present invention. FIG. 14 is a cross-sectional view taken on line XIV—XIV of FIG. 13. In the embodiment, steps 24a–24d are formed in place of grooves and notches for satisfying the coupling condition of Formula (7). When the steps 24a–24d are formed respectively in the holes 14a–d as such, the thickness of medium (dielectric) between the inner conductors 16a–16d and the outer conductor 18 in the upper and lower parts of each resonance element can be changed. Thus, the electrostatic capacity formed in the upper and lower parts change and Z1 differs from Z2 ($Z1 \neq Z2$) in both the even and odd modes, thus the condition of the Formula (7) is satisfied and the coupling is effectuated.

Figure 15:
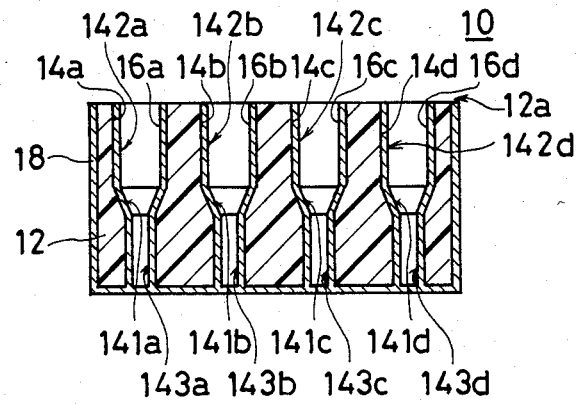
FIG. 15 is a cross-sectional view showing a modified example of the embodiment of FIG. 13.

FIG. 15 is a cross-sectional view showing a modified example of the embodiment of FIG. 13. In the embodiment, the respective holes 14a, 14b, 14c and 14d include large diameter portions 142a, 142b, 142c and 142d and smaller diameter portions 143a, 143b, 143c and 143d respectively continued by taper portions 141a, 141b, 141c and 141d. Then, the inner conductors 16a, 16b, 16c and 16d are formed on the respective inner surfaces of the holes 14a, 14b, 14c and 14d.

The thickness of the dielectric between the large diameter portions 142a–142d of the inner conductors 16a–16d and the outer conductor 18 and, between the small diameter portions 143a–143d and the outer conductor 18 are different, so that the electrostatic capacity being formed differs between the large diameter portions 142a–142d and the small diameter portions 143a–143d. By such a difference of electrostatic capacity, the impedance Z1 and Z2 formed by the two portions 142a–142d and 143a–143d, will differ in both the even and odd modes. Thus, as previously described, the coupling condition is satisfied by satisfying the Formula (7).

In the embodiment of FIG. 13, since the step portion is formed rectangularly or in the like form, the forming thereof is very difficult, resulted in a poor productivity.

Whereas, in the embodiment of FIG. 15, since the large diameter portions are continued to the small diameter portions by the taper portions, the density distribution in the press molding is better than the continued portions formed as the rectangular steps as shown in FIG. 13, and the chips can be eliminated, thus the molding performance is improved. Besides, in the embodiment of FIG. 13 having such rectangular steps, a large turbulence of TEM wave occurs in the step portions, thus resulting in an occurrence of fringing capacity which greatly influences the filtering characteristics. Whereas, according to the embodiment, since the large diameter and small diameter portions are continued by the taper portions, the turbulence of electromagnetic field distribution in the continued portion is small, thus the fringing capacity becomes small and the dielectric filter having the stable characteristic may be obtained.

Figure 16:
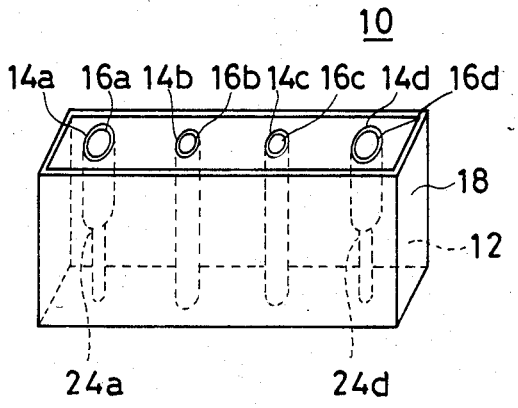
FIG. 16 is a perspective view showing a further modified example of the embodiment of FIG. 13.

FIG. 16 is a perspective view showing a different modified example of the embodiment of FIG. 13. The embodiment differs from that of FIG. 13 in the point that, the steps 24a and 24d are formed only in the holes 14a and 14d. In the embodiment, between all of the resonance elements formed by the inner conductors 16a–16d, the condition of the previous Formula (7) is satisfied due to the steps 24a and 24d mentioned above, whereby the coupling is effectuated. Thus, steps are not necessary to be formed in all holes.

Figure 17:
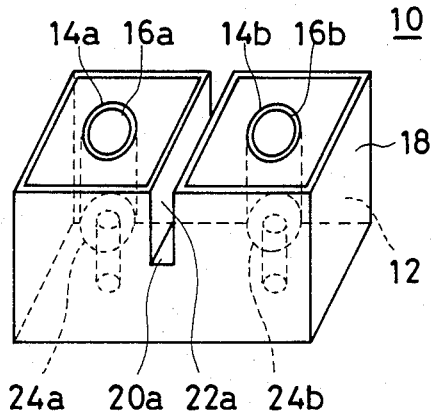
FIG. 17 is a perspective view showing the other modified example of the embodiment of FIG. 13.

FIG. 17 is a perspective view of a major portion showing a further modified example of the embodiment of FIG. 13. The embodiment includes the grooves 20a and corresponding electrode 22a for adjusting the coupling formed on the dielectric block 12 between the hole 14a having the step 24a and the hole 14b having the step 24b.

Meanwhile, it is understood that the taper portion in FIG. 15 can be also used in the embodiments of FIGS. 16 and 17.

Figure 18:
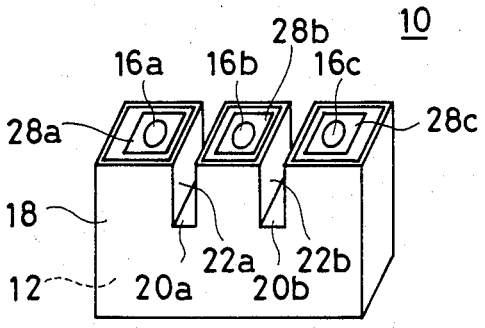
FIG. 18 is a perspective view showing the other modified example of the embodiment of FIG. 5.

FIG. 18 is a perspective view showing a modified example of the embodiment of FIG. 5. This embodiment is generally similar to that in FIG. 5, which has been described previously. The principal difference is that in the embodiment of FIG. 18, electrodes 28a, 28b and 28c connected electrically to the inner conductors 16a, 16b and 16c are formed on the open end surface 12a of the dielectric block 12. With the gap capacity formed by the electrodes 28a–28c and the outer conductor 18, the coupling between each resonance element and the resonant frequency of each resonance element may be adjusted.

Figure 19:
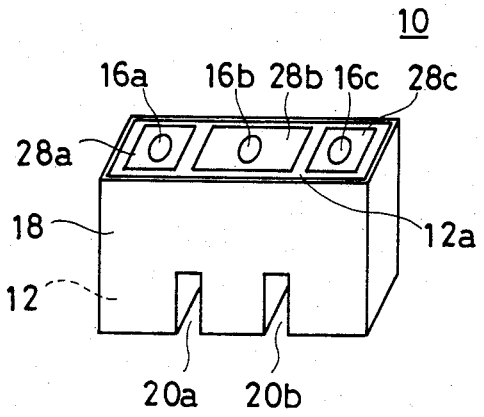
FIG. 19 is a perspective view showing a modified example of the embodiment of FIG. 7.
Figure 20:
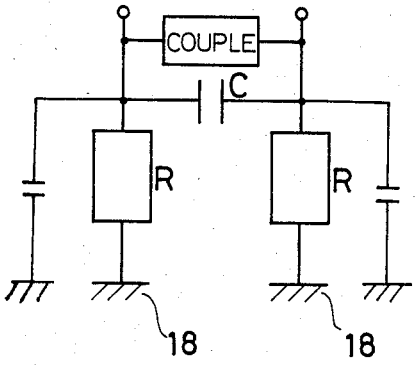
FIG. 20 is an equivalent circuit diagram of the portion between two adjacent resonance elements of the embodiment shown in FIGS. 18 and 19.

FIG. 19 is a perspective view showing a modified example of the embodiment of FIG. 6. FIG. 20 is an equivalent circuit diagram of a portion between two adjacent resonance elements in the embodiment shown in FIGS. 18 and 19. In the embodiment, the electrodes 28a, 28b and 28c connected electrically to the inner conductors 16a, 16b and 16c are formed on the open end surface 12a of the dielectric block 12 and the gap capacity C is formed by the electrodes 28a–28c and the outer conductor 18, and further the gap capacity C are formed between the electrodes 28*a* and 28*b* and between the electrodes 28*b* and 28*c*. With the electrodes 28*a*–28*c*, the coupling between each resonance element and the resonanant frequency of each resonance element may be adjusted.

Figure 21:
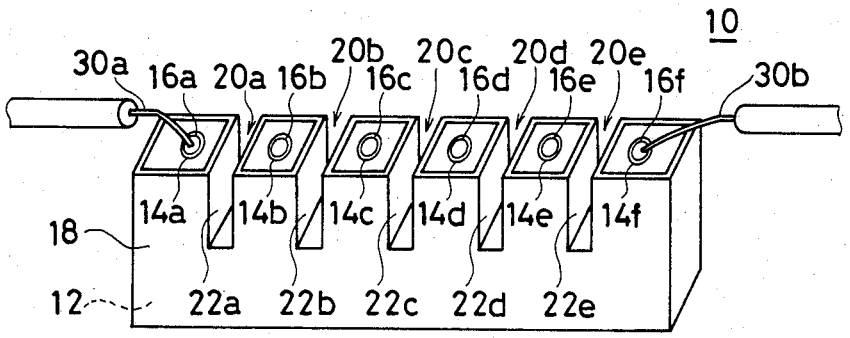
FIG. 21 is a perspective view showing another embodiment in accordance with the present invention.

FIG. 21 is a perspective view showing a further embodiment in accordance with the present invention. The embodiment includes six-stage resonance elements constituted by the inner conductors 16*a*–16*f* and the outer conductor 18. The embodiment includes grooves 20*a*–20*e* and corresponding electrodes 22*a*–22*e* as described above. Then, an input cable 30*a* is connected directly to an inner conductor constituting the resonance element on the input side, for example, the inner conductor 16*a*, and an output cable 30*b* is connected directly to an inner conductor constituting the resonance element on the output side, for example, the inner conductor 16*f*.

Figure 22:
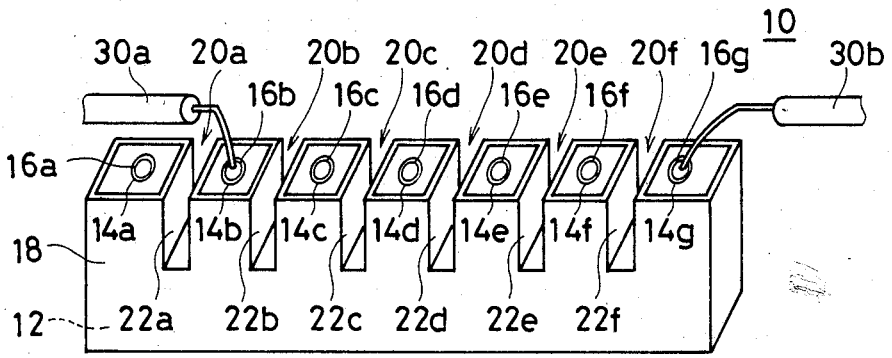
FIG. 22 is a perspective view showing a modified example of the embodiment of FIG. 21.
Figure 23:
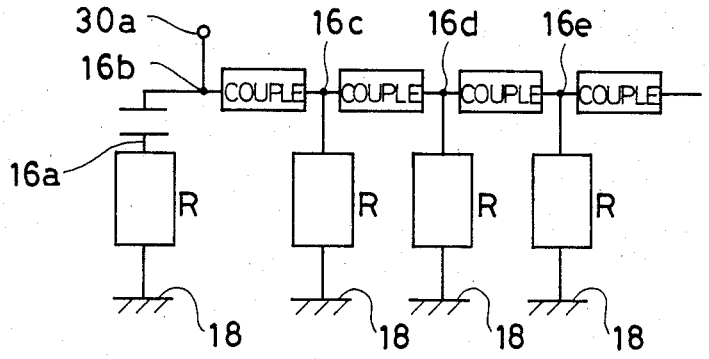
FIG. 23 is an equivalent circuit diagram of the embodiment of FIG. 22.

FIG. 22 is a perspective view showing a modified example of the embodiment of FIG. 21. Reference is made to the description of FIG. 21 above. FIG. 23 is an equivalent circuit diagram of the embodiment of FIG. 22.

In the embodiment, the input cable 30*a* is connected electrically to the inner conductor 16*b* constituting the second resonance element from the left end. According to the embodiment, as shown in FIG. 23, the resonance element on the left end constituted by the inner conductor 16*a* and the outer conductor 18 is used as a trap element.

Figure 24:
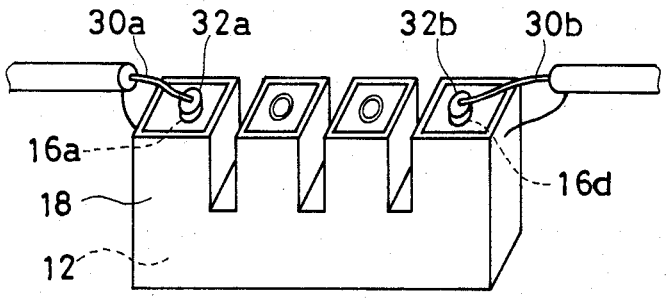
FIG. 24 is a perspective view showing another modified example of the embodiment of FIG. 21.

FIG. 24 is a perspective view showing a modified example of the embodiment of FIG. 21. In the embodiment, reactance elements, for example, plate capacitors 32*a* and 32*b* are inserted and connected respectively between the inner conductor 16*a* and the input cable 30*a* and between the inner conductor 16*d* and the output cable 30*b*.

Meanwhile, in the embodiment described above, although grooves, notches, steps and taper portions are formed on the dielectric block for satisfying Formula (7), the specific electrostatic capacity of a part in the lengthwise direction of the resonance element maybe made to differ from that of the other part, for example, by unequalizing the dielectric constant of the dielectric block.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dielectric filter comprising:

a generally cubic shape dielectric block, an outer conductor formed on an outer surface of said dielectric block, a plurality of holes formed in a main surface of said dielectric block and extending substantially parallel to each other into said dielectric block and thereby defining a direction that is lengthwise with respect to said holes, and a plurality of inner conductors formed on respective inner surfaces of said plurality of holes and respectively constituting resonance elements in cooperation with said outer conductor, the impedance of a first part along said lengthwise direction, from said main surface, of at least one of said resonance elements being unequal to the impedance of a second part of said at least one resonance element, said impedance of said first part being unequal to said impedance of said second part, at least in one of an even mode and an odd mode;

said impedance of said first part of said at least one resonance element being set by impedance changing means which includes thickness changing means to change the amount of dielectric material of said dielectric block surrounding said first part of said resonance element in said lengthwise direction of said resonance element; and said thickness changing means including at least one groove which is formed through said dielectric block adjacent said first part of said resonance element;

said dielectric filter further comprising electrodes formed on the surfaces of said groove and connected electrically to said outer conductor.

2. A dielectric filter comprising:

a generally cubic shape dielectric block, an outer conductor formed on an outer surface of said dielectric block, a plurality of holes formed in a main surface of said dielectric block and extending substantially parallel to each other into said dielectric block and thereby defining a direction that is lengthwise with respect to said holes, and a plurality of inner conductors formed on respective inner surfaces of said plurality of holes and respectively constituting resonance elements in cooperation with said outer conductor, the impedance of a first part along said lengthwise direction, from said main surface, of at least one of said resonance elements being unequal to the impedance of a second part of said at least one resonance element, said impedance of said first part being unequal to said impedance of said second part, at least in one of an even mode and an odd mode;

said impedance of said first part of said at least one resonance element being set by impedance changing means which includes thickness changing means to change the amount of dielectric material of said dielectric block surrounding said first part of said resonance element in said lengthwise direction of said resonance element; and said thickness changing means including at least one groove which is formed through said dielectric block adjacent said first part of said resonance element;

said dielectric filter further comprising coupling adjusting means in the dielectric block for adjusting the coupling between said at least one resonance element and a resonance element adjacent thereto;

said coupling adjusting means including notches formed parallel and adjacent to substantially all of said at least one resonance element, said notches being formed in said dielectric block between said at least one resonance element and said adjacent resonance element; and said notches being formed on corners of said dielectric block formed by said grooves.

3. A dielectric filter comprising:

a generally cubic shape dielectric block, an outer conductor formed on an outer surface of said dielectric block, a plurality of holes formed in a main surface of said dielectric block and extending substantially parallel to each other into said dielectric block and thereby defining a lengthwise direction of said holes, and a plurality of inner conductors formed on respective inner surfaces of said plurality of holes and respectively constituting resonance elements in cooperation with said outer conductor, a first impedance of a first part along said lengthwise direction, from said main surface, of at least one of said resonance elements being unequal to a second impedance of a second part of said at least one resonance element, said first impedance being unequal to said second impedance at least in one of an even mode and an odd mode, a thickness of the dielectric material of said dielectric block, between said first part of said resonance element and said outer surface, being made unequal to a thickness of the dielectric material, between said second part of said resonance element and said outer surface, for providing said respective first and second impedances, and said resonance element being coupled to an adjacent resonance element substantially only by said inequality of said first and second impedances; and a step being formed in said hole in at least one of said at least one resonance element and said adjacent resonance element.

4. A dielectric filter in accordance with claim 3, which further comprises coupling adjusting means in the dielectric block for adjusting the coupling state between said at least one resonance element and said adjacent resonance element.

5. A dielectric filter in accordance with claim 4, wherein said coupling adjusting means include at least one groove formed in said dielectric block adjacent said first part of said resonance element.

6. A dielectric filter comprising:

a generally cubic shape dielectric block, an outer conductor formed on an outer surface of said dielectric block, a plurality of holes formed in a main surface of said dielectric block and extending substantially parallel to each other into said dielectric block and thereby defining a lengthwise direction of said holes, and a plurality of inner conductors formed on respective inner surfaces of said plurality of holes and respectively constituting resonance elements in cooperation with said outer conductor, a first impedance of a first part along said lengthwise direction, from said main surface, of at least one of said resonance elements being unequal to a second impedance of a second part of said at least one resonance element, said first impedance being unequal to said second impedance, at least in one of an even mode and an odd mode, a thickness of the dielectric material of said dielectric block, between said first part of said resonance element and said outer surface, being made unequal to a thickness of the dielectric material, between said second part of said resonance element and said outer surface, for providing said respective first and second impedances, and said resonance element being coupled to an adjacent resonance element substantially only by said inequality of said first and second impedances; and said respective thickness of said first and second parts being provided by respective portions of large diameter and small diameter which are formed in said hole, along the lengthwise direction of said hole, in at least one of said at least one resonance element and said adjacent resonance element.

7. A dielectric filter in accordance with claim 6, wherein a tapered portion is provided in said hole between said large diameter and small diameter portions.

8. A dielectric filter comprising:

a generally cubic shape dielectric block, an outer conductor formed on an outer surface of said dielectric block, a plurality of holes formed in a main surface of said dielectric block and extending substantially parallel to each other in said dielectric block and thereby defining a direction that is lengthwise with respect to said holes; and a plurality of inner conductors formed on respective inner surfaces of said plurality of holes and respectively constituting resonance elements in cooperation with said outer conductor;

the impedance of a first part along said lengthwise direction, from said main surface, of at least one of said resonance elements being unequal to the impedance of a second part of said at least one resonance element, said impedance of said first part being unequal to said impedance of said second part, at least in one of an even mode and an odd mode;

said dielectric filter further comprising input contact means for signal input connected electrically to said inner conductor of one of said plurality of resonance elements, and output contact means for signal output connected electrically to said inner conductor of another of said plurality of resonance elements; and at least one of said plurality of resonance elements being formed as a trap element.

9. A dielectric filter comprising:

a generally cubic shape dielectric block, an outer conductor formed on an outer surface of said dielectric block, a plurality of holes formed in a main surface of said dielectric block and extending substantially parallel to each other into said dielectric block and thereby defining a lengthwise direction of said holes, and a plurality of inner conductors formed on respective inner surfaces of said plurality of holes and respective constituting resonance elements in cooperation with said outer conductor, a first impedance of a first part along said lengthwise direction, from said main surface, of at least one of said resonance elements being unequal to a second impedance of a second part of said at least one resonance element, said first impedance being unequal to said second impedance, at least in one of an even mode and an odd mode, a thickness of the dielectric material of said dielectric block, between said first part of said resonance element and said outer surface, being made unequal to a thickness of the dielectric material, between said second part of said resonance element and said outer surface, for providing said respective first and second impedances, and said resonance element being coupled to an adjacent resonance element substantially only by said inequality of said first and second impedances;

said dielectric filter further comprising input contact means for signal input connected electrically to said inner conductor of one of said plurality of resonance elements, and output contact means for signal output connected electrically to said inner conductor of another of said plurality of resonance elements; and reactance elements interposed between said input and output contact means and the corresponding resonance elements.

10. A dielectric filter comprising:

a generally cubic shape dielectric block, an outer conductor formed on an outer surface of said dielectric block, a plurality of holes formed in a main surface of said dielectric block and extending substantially parallel to each other into said dielectric block and thereby defining a lengthwise direction of said holes, and a plurality of inner conductors formed on respective inner surfaces of said plurality of holes and respectively constituting elements in cooperation with said outer conductor, a first impedance of a first part along said lengthwise direction, from said main surface, of at least one of said resonance elements being unequal to a second impedance of a second part of said at least one resonance element, said first impedance being unequal to said second impedance, at least in one of an even mode and an odd mode, a thickness of the dielectric material of said dielectric block, between said first part of said resonance element and said outer surface, being made unequal to a thickness of the dielectric material, between said second part of said resonance element and said outer surface, for providing said respective first and second impedance, and said resonance element being coupled to an adjacent resonance element substantially only by said inequality of said first and second impedances; and the impedance of said first part of said at least one resonance element being changed by means for changing the electrical angle of said first part in the lengthwise direction of said at least one of said resonance elements from that of said second part, at least in one of said even and odd modes.

* * * * *